US009052152B2

(12) United States Patent
Moss et al.

(10) Patent No.: US 9,052,152 B2
(45) Date of Patent: Jun. 9, 2015

(54) SYSTEM AND METHOD FOR MULTI-STAGE BYPASS, LOW OPERATING TEMPERATURE SUPPRESSOR FOR AUTOMATIC WEAPONS

(71) Applicant: Lawrence Livermore National Security, LLC, Livermore, CA (US)

(72) Inventors: William C. Moss, San Mateo, CA (US); Andrew T. Anderson, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 326 days.

(21) Appl. No.: 13/764,380

(22) Filed: Feb. 11, 2013

(65) Prior Publication Data

US 2015/0101882 A1 Apr. 16, 2015

Related U.S. Application Data

(60) Provisional application No. 61/682,147, filed on Aug. 10, 2012.

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/00
USPC ..... 89/14.4; 181/223
See application file for complete search history.

(56) References Cited

U.S. PATENT DOCUMENTS

| | | | | |
|---|---|---|---|---|
| 916,885 | A | 3/1909 | Maxim | 181/223 |
| 3,492,912 | A * | 2/1970 | Ashbrook | 89/14.3 |
| 6,425,310 | B1 * | 7/2002 | Champion | 89/14.3 |
| 6,575,266 | B1 * | 6/2003 | Gehse et al. | 181/223 |
| 8,096,073 | B2 * | 1/2012 | Vielbig | 42/1.01 |
| 8,196,701 | B1 | 6/2012 | Oliver | 181/223 |
| 8,286,750 | B1 | 10/2012 | Oliver | 181/223 |
| 8,739,922 | B2 * | 6/2014 | Wirth et al. | 181/223 |
| 8,967,326 | B2 * | 3/2015 | Schlosser | 181/223 |
| 2011/0107900 | A1 * | 5/2011 | Presz et al. | 89/14.4 |
| 2012/0272818 | A1 * | 11/2012 | Dueck et al. | 89/14.4 |
| 2014/0318887 | A1 * | 10/2014 | Latka | 181/223 |
| 2014/0374189 | A1 * | 12/2014 | Young et al. | 181/223 |
| 2015/0001001 | A1 * | 1/2015 | Wilson | 181/223 |

OTHER PUBLICATIONS

Skochko, L. W. et. al. "Silencers, principles and evaluations", Report # R-1896, Dept. of the Army, Frankford Arsenal, Philadelphia, PA (1968), pp. 2-7, 119, 122-123, and 150.

* cited by examiner

*Primary Examiner* — Forrest M Phillips
(74) *Attorney, Agent, or Firm* — James S. Tak

(57) ABSTRACT

The present disclosure relates to a suppressor for use with a weapon. The suppressor may be formed to have a body portion having a bore extending concentric with a bore axis of the weapon barrel. An opening in the bore extends at least substantially circumferentially around the bore. A flow path communicates with the opening and defines a channel for redirecting gasses flowing in the bore out from the bore, through the opening, into a rearward direction in the flow path. The flow path raises a pressure at the opening to generate a Mach disk within the bore at a location approximately coincident with the opening. The Mach disk forms as a virtual baffle to divert at least a portion of the gasses into the opening and into the flow path.

22 Claims, 6 Drawing Sheets

SYSTEM AND METHOD FOR MULTI-STAGE BYPASS, LOW OPERATING TEMPERATURE SUPPRESSOR FOR AUTOMATIC WEAPONS

CROSS-REFERENCE TO RELATED APPLICATIONS

This application claims the benefit of U.S. Provisional Application No. 61/682,147 filed on Aug. 10, 2012. The disclosure of the above application is incorporated herein by reference.

STATEMENT OF GOVERNMENT RIGHTS

The United States Government has rights in this invention pursuant to Contract No. DE-AC52-07NA27344 between the U.S. Department of Energy and Lawrence Livermore National Security, LLC, for the operation of Lawrence Livermore National Laboratory.

FIELD

The present disclosure relates to noise and flash suppressors, and more particularly to noise and flash suppressors that are well adapted for use with weapons having a high rate-of-fire, such as machine guns, fully and semi-automatic rifles and fully and semi-automatic handguns.

BACKGROUND

The statements in this section merely provide background information related to the present disclosure and may not constitute prior art.

Firearms produce noise and flash. A suppressor is a device that attaches to the muzzle of the weapon and reduces noise and flash. For more than 100 years suppressors have been designed typically for single shot or low rate-of-fire weapons, for example semi-automatic rifles and handguns. Conventional suppressors perform acoustic suppression using internal baffles and chambers that both trap and delay the propellant gasses from exiting the barrel of the weapon. Such previous suppressor designs generally operate by expanding and cooling the hot expanding propellant gasses in the internal chambers of the suppressor, then delaying the release of the expanding propellant gasses, which transfers heat to the suppressor. The additional time that the propellant spends in the suppressor before being discharged to the ambient atmosphere results in a reduced acoustic signature.

Conventional suppressor designs, however, are not well suited for weapons having a high rate-of-fire, for example machine guns. Machine guns, as well as fully automatic and semi-automatic rifles and handguns can produce high rates-of-fire, typically bursts at dozens or even hundreds of rounds per minute. These rapid rates of fire produce unacceptably long dwell times for the expanding propellant gasses that are contained inside the suppressor. The long dwell times for the expanding propellant gasses can cause overheating and failure, and potentially even melting, of the internal components of a conventional noise/flash suppressor. The unacceptably long dwell times can also dramatically increase the backpressure experienced by the weapon and thus potentially cause malfunctioning of the weapon.

SUMMARY

In one aspect the present disclosure relates to a suppressor for use with a weapon that fires a bullet. The suppressor is adapted to be secured to a distal end of a barrel of the weapon. The suppressor may include a body portion having a bore extending concentric with a bore axis of the barrel when the suppressor is attached to the distal end of the barrel. An opening is formed in the bore of the body portion which extends at least substantially circumferentially around the bore. A flow path is in communication with the opening and defines a channel for redirecting expanding propellant gasses flowing in a forward direction in the bore out from the bore, through the opening, initially into a rearward direction in the flow path, and then subsequently back into the bore. The flow path helps to raise a pressure at the opening to a level which is sufficient to generate a Mach disk within the bore at a location approximately coincident with the opening when a bullet from a cartridge is fired into the barrel. The Mach disk acts as a virtual baffle to divert at least a portion of the expanding propellant gasses behind the bullet into the opening and into the rearward direction defined by the flow path. A discharge port is in communication with the bore. The discharge port is formed at a downstream end of the suppressor where the bullet and the expanding propellant gasses exit the barrel.

In another aspect the present disclosure relates to a suppressor for use with a weapon that fires a bullet. The suppressor is adapted to be secured to a distal end of a barrel of the weapon. The suppressor may include a body portion having a bore extending concentric with a bore axis of the barrel when the suppressor is attached to the distal end of the barrel. An opening is formed in the bore of the body portion and defines a first area extending circumferentially around the bore. A serpentine flow path is in communication with the opening. The serpentine flow path may have a first portion, a second portion and a downstream portion. The first portion redirects expanding propellant gasses flowing in a forward direction in the bore in a rearward direction and defines a second area. The first portion of the serpentine flow path and the opening cooperate to create an increase in pressure at the opening to a level which is sufficient to create a Mach disk at or adjacent to the opening. The Mach disk acts as a virtual baffle to divert the expanding propellant gasses behind a bullet travelling through the bore from the bore into the opening, and into the first portion of the serpentine flow path. A discharge port is in communication with the bore. The discharge port is formed at a downstream end of the suppressor where the bullet and the expanding propellant gasses exit the barrel.

In another aspect the present disclosure relates to a method for suppressing flash and attenuating noise from a weapon that fires a bullet. The flash and noise are generated by expanding propellant gasses exiting from a distal end of a barrel of the weapon as the bullet is fired from the weapon. The method may comprise securing a suppressor body having a bore to the barrel of the weapon. An opening in the bore of the suppressor is in flow communication with a serpentine flow path for diverting expanding propellant gasses flowing in a forward direction through the bore out from the bore, and redirecting the expanding propellant gasses in a rearward direction into the serpentine flow path. The serpentine flow path and the opening are used to create a volume of increased pressure at the opening sufficient to create a Mach disk within the bore at or adjacent to the opening. The Mach disk acts as a virtual baffle to divert a portion of the expanding propellant flow out from the bore through the opening and into the serpentine flow path.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
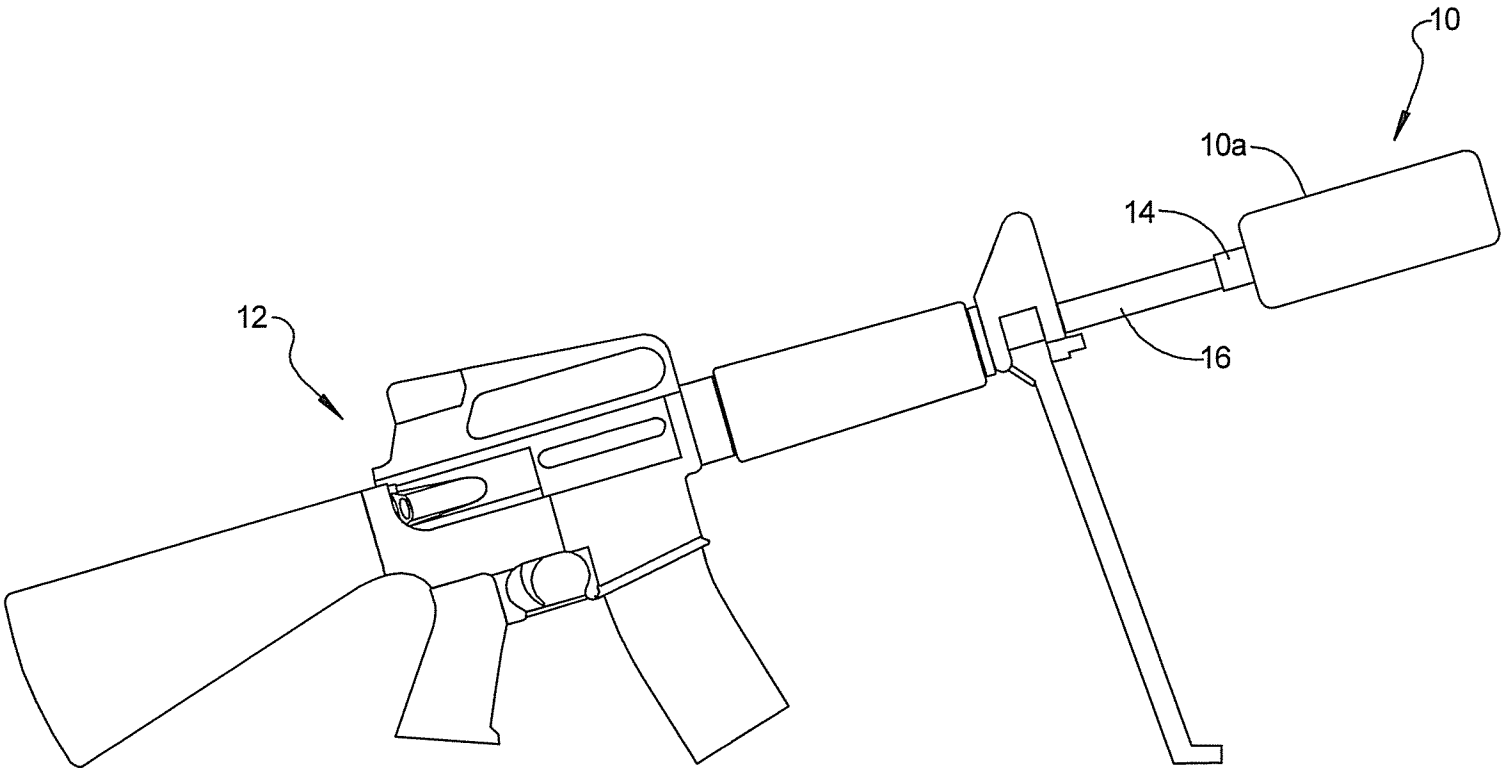
FIG. 1 is a perspective view of an automatic weapon, in this example a machine gun, with a suppressor in accordance with one embodiment of the present disclosure attached to a distal end of the barrel of the weapon.

The following description is merely exemplary in nature and is not intended to limit the present disclosure, application, or uses. It should be understood that throughout the drawings, corresponding reference numerals indicate like or corresponding parts and features.

Referring to FIG. 1 there is shown a flash/noise suppressor 10 in accordance with one embodiment of the present disclosure attached to a distal end 14 of a barrel 16 of a weapon 12. The weapon 12 in this example is a fully automatic machine gun, however, it will be appreciated that the suppressor 10 may be used with semi-automatic weapons, with weapons that have both semi-automatic and fully automatic firing capability, and even handguns that have semi-automatic and fully automatic firing capability. Accordingly, the illustration of the weapon 12 as a machine gun is merely meant to represent one specific type of firearm that the suppressor 10 is well suited for use with. However, due to the significant heat reduction that the suppressor 10 provides (compared to a traditional suppressor), it is expected that the suppressor 10 will find particular utility in use with machine guns that are capable of providing, and are typically used to provide, bursts of fire on the order of dozens or even hundreds of rounds of ammunition per minute. In such applications conventional suppressors typically cannot withstand the severe heating that is generated from prolonged, rapid fire bursts produced by a fully automatic weapon. The severe heating that the expanding propellant gasses impart to a conventional noise suppressor simply cannot be dissipated quickly enough by the suppressor, and thus can quickly damage the suppressor. Even conventional noise suppressors that have been designed for use with automatic weapons have shown only a limited ability to withstand the severe temperatures that are encountered when firing repeated, rapid bursts of ammunition from a weapon.

In FIG. 1 the suppressor 10 may be attached by a conventional threaded connection with the distal end 14 of the barrel 16 or by any other suitable method or means of attachment, such as for example a quick connect/disconnect mechanism. The conventional threaded connection has not been shown, but it will be appreciated that this may involve providing internal threads at input end 10*a* of the suppressor 10 and external threads on the distal end 14 of the barrel 16, as is well known in the firearms industry.

Figure 2:
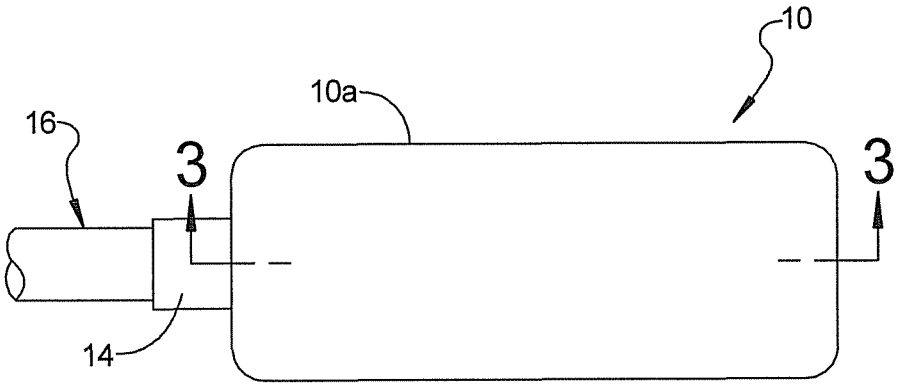
FIG. 2 is a plan view of the suppressor and a distal portion of the barrel of the weapon.

Referring to FIG. 2, the suppressor 10 may overlap a significant portion of the barrel 16, for example on the order of about 2-5 inches. The greater the amount of overlap, the more compact the weapon 12 will be. As will be explained in the following paragraphs, the embodiment of the suppressor 10 shown in FIG. 1 includes a serpentine flow path that helps to limit the overall length of the suppressor 10, and thus helps to maintain a relatively compact profile for the barrel 16 of the weapon 12. The suppressor 10 may have an overall length that varies considerably, but in one preferred form its length is between about 7.0 inches-8.0 inches, and more preferably around 7.2 inches, and its diameter may between about 1.5-3.0 inches, and more preferably about 2.1 inches. However, as noted above, these dimensions merely represent one example of the dimensions that the suppressor 10 may take, and in actual practice the specific dimensions are likely to be selected at least in part based on the specific type/model of weapon that the suppressor 10 is to be used with and the caliber of ammunition that the weapon will be firing.

Figure 3:
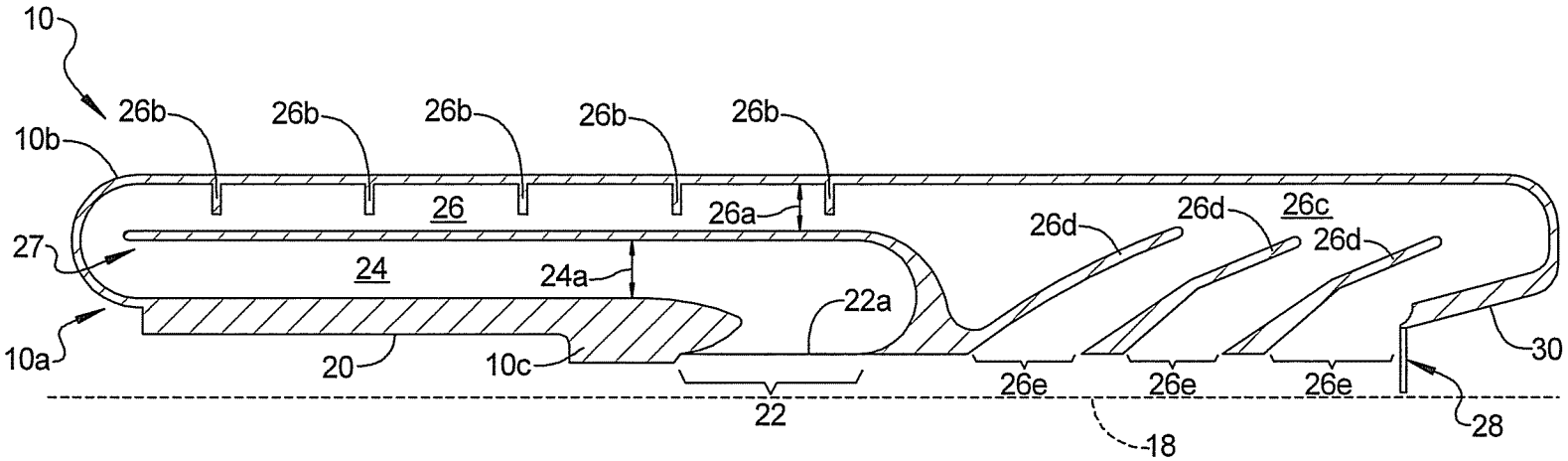
FIG. 3 is a cross sectional view of the suppressor of FIG. 2 taken in accordance with section line 3-3 in FIG. 2.

Referring to FIG. 3 the internal construction of the suppressor 10 can be seen. Dashed line 18 represents an axial center (hereinafter "axis 18") of the bore of the barrel 16 (i.e., the "bore axis") as well as the axial center of a bore 20 of the suppressor 10. The suppressor 10 has a body portion 10*b* which may include a threaded portion 10*c* adapted to receive the threads (not shown) at the distal end 14 of the barrel 16. In FIG. 3 the threaded portion 10*c* is shown positioned well within an interior volume of the suppressor 10, although it could be positioned at input end 10*a* (FIG. 2 also) just as well. An opening 22 is formed in the bore 20 preferably at, or close to, a midpoint of the suppressor's 10 axial length. The opening 22 may form a circumferential opening that extends fully circumferentially around the axis 18, or it may extend only substantially circumferentially around the axis 18. It is anticipated that in most implementations the opening 22 will be most effective if it is extends fully circumferentially around the dashed line 18. It is appreciated that the cross-section of the suppressor 10 shown in FIG. 3 is radially symmetric about the axis 18. As such, the opening 22 may define an area which is the circumferential projection (either fully or substantially) of the width, demarcated at arrow 22*a*, of the opening about the axis 18 such that the area of the opening has a characteristically cylindrical shape.

The opening 22 is in communication with a first generally linear flow portion 24 (hereinafter simply the "first portion 24"). The first portion 24 defines a first volume and a cross sectional area which, similar to the area of the opening 22, is the circumferential projection (either fully or substantially) of the width, demarcated at arrow 24*a*, of the first portion about the axis 18 such that the area is a fully or substantially ring-shaped cross sectional area. The first portion 24 is in flow communication with a second generally linear flow portion 26 (hereinafter simply "second portion 26"). The second portion 26 defines a second volume, and similar to the first portion 24, also defines a cross-sectional area which is the circumferential projection (either fully or substantially) of the width, demarcated at arrow 26*a*, of the second portion about the axis 18 such that the area is a fully or substantially ring-shaped cross sectional area. The second portion 26 may include a plurality of baffles 26*b* projecting orthogonal relative to the axis 18. The baffles 26*b* may be spaced apart from one another along the length of the second portion 26, but do not necessarily need to have the same radial extent (i.e., dimension) as depicted in FIG. 3. The second portion 26 may also have a downstream portion 26*c* that defines a third volume. The downstream portion 26*c* may include a plurality of axially spaced apart, swept vanes 26*d*, which also may function as baffles, which define flow passages 26*e* there between. The downstream portion 26*c* is in communication with the bore 20 and with a discharge port 28. The discharge port 28 may have a frusto-conical nozzle portion 30. The frusto-conical nozzle portion 30 defines a short flow path of expanding volume just downstream of the discharge port 28. The opening 22, the first and second portions 24 and 26, respectively, and the flow passages 26*e* collectively form a compact, serpentine flow path 27 through the suppressor 10, where the first portion 24 and a substantial length of the second portion 26 are both positioned upstream (relative to the direction of expanding propellant flow) of the opening 22.

The suppressor 10 may be made from any material that is suitable for withstanding the high temperatures that are encountered from firing bursts of ammunition from a fully automatic weapon. In one embodiment the suppressor is made from steel, but other materials, for example, titanium, Inconel or any other suitable high strength material could be used as well. During firing of a cartridge from the weapon 12, a bullet from the cartridge will travel from left to right through the suppressor 10 in FIG. 3. The bullet is driven by the hot, combusted, expanding propellant gasses behind it discharged from the barrel 16. Analyses of experimental noise data collected during firing of the weapon 12 with the suppressor 10 attached to it show that the peak acoustic signal that is measured with noise detectors placed in the vicinity of weapon 12, and particularly near the shooter's ear, arise from the expanding propellant gasses just behind the bullet as the bullet initially leaves the suppressor 10. This time period corresponds to approximately the first 0.25 ms after the bullet exits the discharge port 28 of the suppressor 10. It is believed that the co-inventors of the present disclosure are the first to discover the importance of the first approximately 0.25 ms after the bullet leaves the suppressor 10, and its significant influence on noise.

In view of the foregoing knowledge that the expanding propellant gasses behind the bullet have an especially significant effect on noise during the first 0.25 ms after the bullet leaves the barrel 16, it becomes highly important to be able to divert as much of the expanding propellant gasses out from the bore 20 through the opening 22 as possible. Put differently, it becomes highly important to minimize the amount of the expanding propellant gasses flowing along the bore 20 of the suppressor 10 during the critical ~0.25 ms. The opening 22 accomplishes this by creating what may be termed a "virtual baffle" through the creation of a "Mach disk" at the opening 22, and more particularly at or near a downstream end of the opening 22. Generally speaking, with a conventional suppressor a Mach disk may arise outside the suppressor when the supersonic flow of the expanding propellant gasses exits the suppressor at supersonic velocities. Mach disks are often observed when shooting a bare muzzle weapon (i.e., no suppressor or flash hider attached). A Mach disk, which can also be viewed as a "shock" normal to the flow direction, tends to appear at about 10-15 bore diameters from the bare muzzle, or at about 9 cm for a 7.62 mm caliber weapon. However, the Mach disk that is formed within the suppressor 10 forms very near the opening 22, or at or near a downstream end of the opening 22. It is believed that the reason for this is the elevated gas pressure around the Mach disk. In the bare muzzle case, the surrounding ambient pressure yields a Mach disk pressure of only a couple bars or so. With the suppressor 10 of the present disclosure, however, the turning channel formed by the first portion 24 (off the axis 18 of bore 20) into which the expanding propellant gasses initially flow in a rearward direction causes the pressure to increase to a hundred or more bars near the bore axis (axis 18) of the weapon barrel 16 adjacent to or at the opening 22. It is believed that this elevated pressure is an important factor that forces the Mach disk to form in a more compact region, essentially at the opening or within a centimeter or two of the downstream end of the opening 22. Without the Mach disk being formed inside the bore 20 at or adjacent to the opening 22, there would be significantly reduced diversion of the expanding propellant gasses flowing out from the bore 20 and into the opening 22 than what occurs when the Mach disk is created at or near the downstream end of the opening 22. So in summary it is believed to be the geometric construction of the first portion 24 of the serpentine flow path 27, and in particular the initial rearward diversion of the flow into the serpentine flow path, enhances a stagnation of the expanding propellant gasses flowing through the suppressor 10, with a concomitant large increase in pressure, that augments the formation of a compact Mach disk at or near the downstream end of the opening 22.

It is also believed that the axial length of the opening 22 is important for generating a Mach disk at or closely adjacent to the downstream end of the opening 22. An opening that is too short will not permit sufficient flow of the expanding propellant gas therethrough to initially help create the significant increased pressure seen at the opening 22. But an axial distance which is too long may allow the expanding propellant gas to enter the region between 22*a* and 24*a* and then flow back into the bore 20 downstream of the Mach disk as the Mach disk begins to form, thus reducing the total amount of gas that is diverted from the bore line flow. The axial length of the opening 22 is preferably chosen to be on the order of from about three to four bore diameters. So for a 7.62 mm bore diameter, an axial length of around one inch or so is likely to be optimal.

Figure 4:
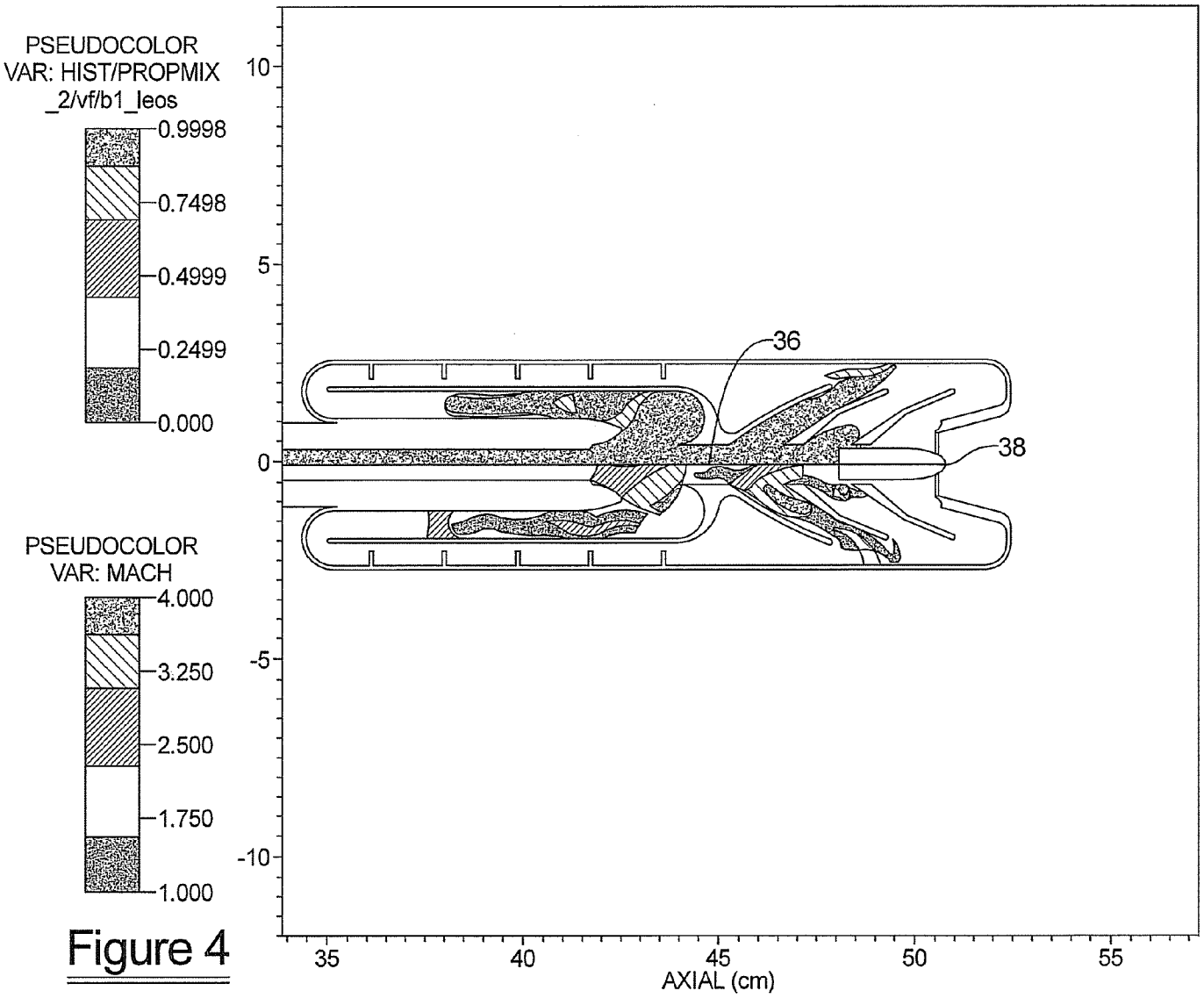
FIG. 4 shows the suppressor of FIG. 3 in which the upper half of the drawing uses different shading to indicate the relative proportions of air and propellant at various locations within the suppressor when a bullet is being propelled through a bore of the suppressor, and wherein various types of shading are used in the lower half of the drawing to indicate the velocities of the air and expanding propellant gas at various locations within the suppressor as the expanding propellant gasses are propelling the bullet down the bore of the suppressor during the first shot from the weapon, for which initially, the suppressor is filled completely with ambient air.

The lower half of FIG. 4 illustrates the velocities of the expanding propellant gasses, and air, indicated by Mach number, at various points within the suppressor 10 as a bullet 38, fired from an initial shot from the weapon 12, is travelling through the bore 20. It will be appreciated that the Mach number is a dimensionless number equal to the gas velocity divided by the speed of sound in the gas, where the gas may be a mixture of the air and the expanding propellant gasses. Immediately prior to the first shot it will be appreciated that the suppressor 10 will be completely filled with ambient air. FIG. 4 shows that the flow of the expanding propellant gasses becomes mostly subsonic across the bore 20 at approximately point 36 as a result of the Mach disk that has been created at or near the downstream end of the opening 22. This serves to divert a substantial portion of the expanding propellant gasses flowing into the opening 22 and into the channel defined by first portion 24 of the suppressor 10, thus removing it from the bore 20.

The upper half of the suppressor 10 shown in FIG. 4 indicates the level of mixture of the expanding propellant gasses and the air inside the suppressor 10. A value of "1" indicates 100% expanding propellant gasses while a value of 0 indicates 100% air.

The Mach disk created approximately at point 36 in FIG. 4 is believed to be caused by at least two factors. The first is by forming a rearwardly directed (i.e., flow back toward the weapon 12) flow path, using the first portion 24, directly communicating with the opening 22. The second is by carefully selecting the areas of the opening 22 and the first portion 24. The area of the opening 22 is preferably selected to be at least about equal to, but more preferably slightly greater than, the cross sectional flow area of the first portion 24. Thus, the ratio of the cross sectional flow area of the opening 22 to the cross sectional flow area of the first portion 24 should be close to 1:1, but more preferably about 1:1 or even slightly greater than 1:1.

At least the above discussed factors are believed to be highly important in the formation of a high pressure region near the downstream end of the opening 22, which is responsible for creating the compact Mach disk. A well-known phenomenon in this type of supersonic flow is that most of the mass flow diverts around the Mach disk. Accordingly, the Mach disk effectively operates as a "virtual baffle" to divert a substantial portion of the expanding propellant gasses out from the bore 20 of the suppressor 10. Numerical simulations have indicated that upwards of 90%, or possibly more, of the expanding propellant gasses are diverted into the opening 22 and into the first portion 24 (i.e., bypass channel) of the suppressor 10. Since no physical wall structure is needed to help achieve this significant diversion of the expanding propellant flow, the overall diameter of the suppressor 10 can be kept highly compact while efficiently managing the expanding propellant gasses flowing through the suppressor 10. It will also be appreciated that since Mach disks cause large jumps in pressure and temperature in front of the Mach disk, it is counterintuitive that creating the internal Mach disk within the bore 20 will result in a significantly lower propellant gas pressure outside the suppressor 10, for example at the shooter's ear. Managing the flow in the bore 20 by using the Mach disk to divert more of the expanding propellant gasses flowing into the first portion 24 (i.e., the bypass channel) while reducing the bore 20 expanding propellant flow to subsonic speeds in front of the Mach disk is seen to substantially negate these other consequences of Mach disk formation.

The first portion 24 and second portion 26 of the suppressor 10 are used to provide expansion volume for the expanding propellant gasses to further assist with diverting flow of the expanding propellant gasses ultimately into the second portion 26. Baffles 26*b* impede the flow of the expanding propellant gasses through the second portion 26 and slow the buildup of pressure in the downstream portion 26*c* so that additional flow can be diverted through flow passages 26*e*. The swept vanes 26*d* also help to define flow passages 26*e*, which serve as reentry points for the expanding propellant gasses to flow back into the bore 20 near the discharge port 28, thus allowing the suppressor 10 to empty. This serves to lengthen the overall time (compared to a bare muzzle) that the expanding propellant gasses remain within the suppressor 10 before being discharged through the flow passages 26*e* and then through the discharge port 28. This multi-stage configuration of the opening 22, first portion 24, second portion 26, downstream portion 26*c* and swept vanes 26*d* provides a balance between the need to divert the expanding propellant gasses from the bore 20 and expanding and trapping the propellant gasses in the suppressor 20, but ultimately allowing the expanding propellant gasses to be quickly exhausted back through the flow passages 26*e* and discharged to reduce the heat absorbed by the suppressor 10. The net effect provided by this configuration is a reduction of the peak pressure, pressure gradients and temperature of the expanding propellant gasses when they initially exit the suppressor 10.

Another feature of the suppressor 10 is the design of the discharge port 28, and more specifically the use of the frusto-conical nozzle portion 30. The frusto-conical nozzle portion 30 helps to expand the propellant gasses as they exit the suppressor 10, as well as to reduce the temperature of the gasses. This reduces the likelihood of flash production. The construction of the discharge port 28 also ensures no cross flow of the expanding propellant gasses across the bore 20 near the discharge port, thus minimizing bullet dispersion.

It will also be appreciated that the time that it takes for the suppressor 10 to empty a given quantity of expanding propellant gas through the discharge port 28 is controlled primarily by the area of the discharge port 28 opening. A larger area for the discharge port 28 opening will allow more rapid emptying of the expanding propellant gasses, and less heat build-up in the suppressor 10. A smaller area for the discharge port 28 opening creates a longer emptying time and an increased amount of heat transfer to the suppressor 10. Long emptying times also result in high pressure in any type of suppressor, which can have deleterious effects on the cycling speed of a fully automatic weapon such as a machine gun. More specifically, long emptying times can adversely affect bolt operation and blowback from the chamber during operation. Based on numerical simulations, it has been determined that the area chosen for the discharge port 28 opening should be an area that facilitates an approximate 12-20 ms emptying time for the expanding propellant gasses from the suppressor 10. By "emptying time" it is meant the period of time from when a quantity of the expanding propellant gas generated by firing a single cartridge initially begins to enter the suppressor 10, to when that quantity of expanding propellant gas has been substantially discharged from the suppressor. A 12-20 ms emptying time is believed to be an optimal, or close to optimal, emptying time that reduces thermal transfer to the suppressor 10 and keeps the pressure within the suppressor 10 low enough so that the suppressor does not significantly affect cycling time of the weapon 12, its bolt operation or blowback. With the presently discussed suppressor 10, the ratio of the area of the discharge port 28 opening to the bore 20 area of approximately 4.2 provides the desired 12-20 ms emptying time.

It will also be noted that the particular choice of emptying time for the suppressor 10 will be weapon-dependent. The dimensions provided herein for the discharge port 28 opening of the suppressor 10 are believed to optimize, or at least nearly optimize, the suppressor 10 for use with at least one specific weapon, that being the Mk48 (7.62 mm×51 mm) machine gun made by Fabrique Nationale Manufacturing, Inc., which is a division of FN Herstal, of Columbia, S.C. Other calibers of weapons will likely require a proportional adjustment of the area of the discharge port 28 opening, the opening 22, in addition to volume and dimensions of the flow portions 24 and 26, to achieve an emptying time consistent with minimally affecting the maximum duty cycle of the weapon. It is also possible that varying slightly from the above mentioned 12-20 ms emptying time may be desired for different makes and/or calibers of weapons to optimize overall noise and flash reduction by the suppressor 10.

Furthermore, it will be noted that the suppressor 10 has been described as having a serpentine flow path made up of the opening 22, flow portions 24 and 26 and the flow passages 26*e*, and thus can be viewed as forming an "over-the-barrel" configuration. By "over-the-barrel" configuration it is meant that a portion of the flow path within the suppressor 10 extends back over a portion of the barrel 16 of the weapon 12, which significantly reduces the extent that the suppressor 10 adds to the length of the weapon 12. This is important in maintaining the weapon 12 in as compact a configuration as possible and thus provides a significant practical/operational convenience. Nevertheless, the suppressor 10 could be implemented in other forms that are not of the serpentine flow path variety. The internal design of the suppressor 10 also has the effect of limiting the surface area of the internal surfaces of the suppressor which helps to minimize heat transfer to the suppressor. This also serves to help minimize the overall weight of the suppressor 10.

Figure 5:
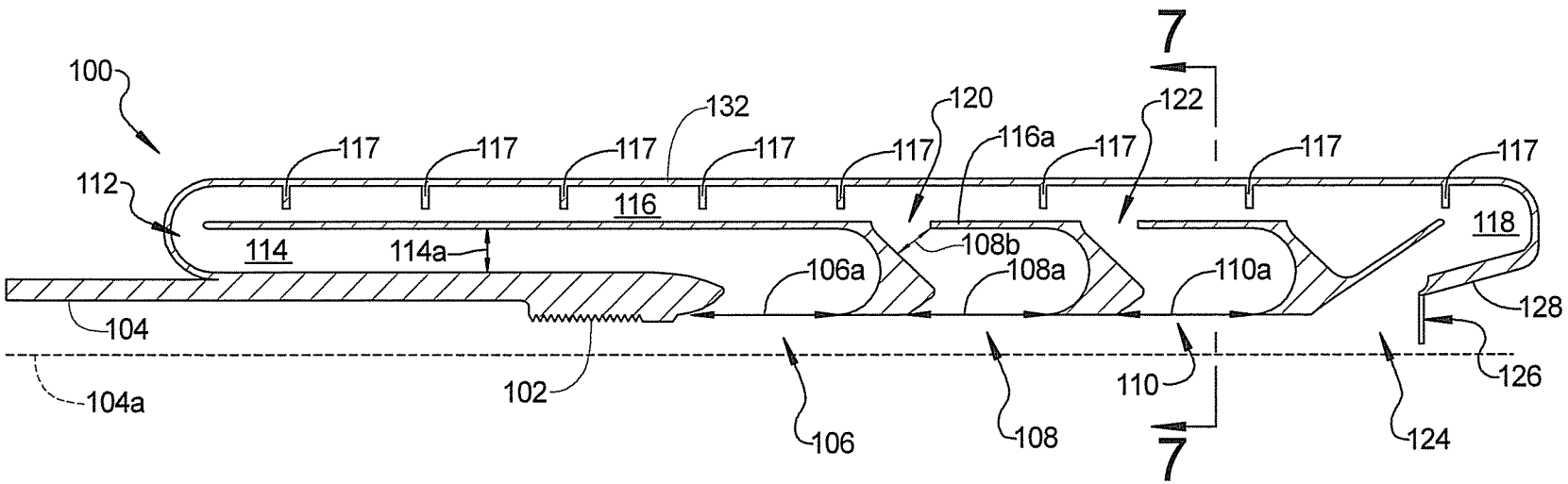
FIG. 5 is a simplified side cross sectional view of one half of a suppressor in accordance with another embodiment of the present disclosure.
Figure 6:
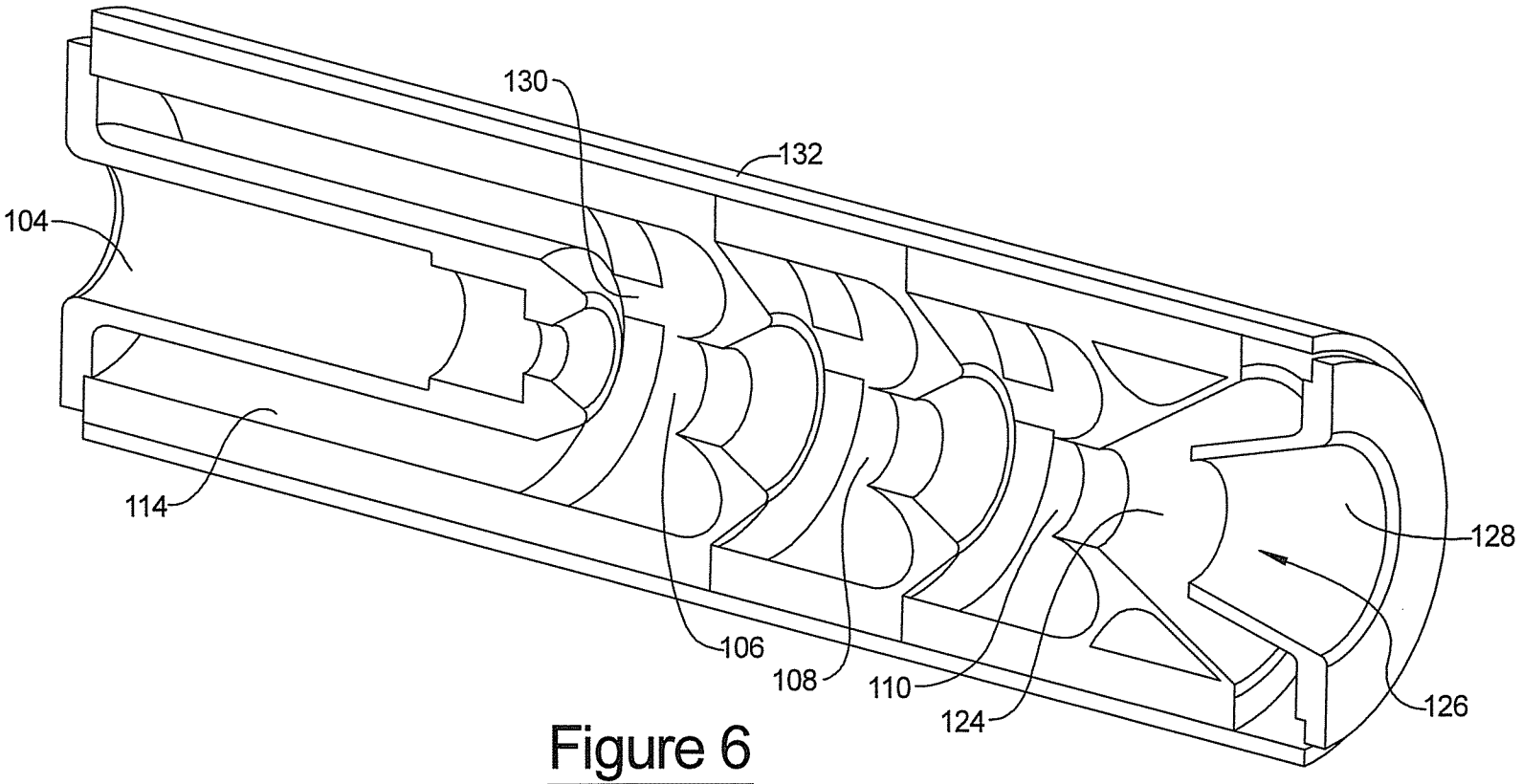
FIG. 6 is a perspective cutaway view of a portion of the suppressor of FIG. 5 further illustrating its internal construction.

Referring now to FIGS. 5 and 6, a suppressor 100 in accordance with another embodiment of the present disclosure is shown. It will be appreciated that the suppressor 100 may be identical in its overall dimensions, or just slightly longer in its overall dimensions, to the suppressor 10 shown in FIG. 2. FIG. 5 illustrates an axisymmetric representation of suppressor 100 from the axis 18 radially outward. The suppressor 100 may also have an outward appearance identical to, or essentially identical to, the suppressor 10. The suppressor 100 may be just slightly longer than the suppressor 10, for example between about 7.5-8.5 inches, and preferably about 8.0-8.2 inches in overall length. The suppressor 100, as will be described in detail in the following paragraphs, operates to generate a plurality of axially spaced apart Mach disks within its bore when a bullet is fired into the suppressor 100, which even further helps to reduce the noise and muzzle flash being generated from the suppressor 100. Simulations and experiments show that this configuration is approximately 2 dB quieter, at the shooter's ear, than the suppressor 10 in FIG. 3. Possibly more important, the measured first round flash peak luminosity of suppressor 10 is reduced by a factor of approximately 15 compared to that for the suppressor 100.

In FIGS. 5 and 6, the suppressor 100 may have a threaded portion 102 within a bore 104 for accepting a threaded portion of the barrel 16. The bore 104 has a bore line 104*a* which is coaxial with the bore axis 18 of the barrel 16 when the suppressor is secured to the barrel 16. The bore includes first, second and third axially spaced apart, circumferential openings 106, 108 and 110. The openings are preferably fully circumferential openings but they may merely partially circumferential openings as well. The first opening 106 is defined by a cylindrically shaped area represented in part by line 106*a*, the second opening is defined by a cylindrically shaped area represented in part by line 108*a* and the third opening is defined by a cylindrically shaped area represented in part by line 110*a*. The first opening 106 is in flow communication with a first portion 114 of a serpentine flow path 112. The serpentine flow path 112 has a second portion 116 in communication with the first portion 114, and a third portion 118 in communication with the second portion 116. The second portion 116 may include a plurality of axially spaced apart baffles 117 projecting orthogonal to the axis of the expanding flow through the second portion 116. The baffles 117 serve to impede and delay the flow of the expanding propellant gasses through the second portion 116. The first opening 106 forms at least a partial circumferential opening, but more preferably a fully circumferential opening about the bore 104. Similarly, each of the second and third openings 108 and 110 form partial, or more preferably complete, circumferential openings about the bore 104. The second opening 108 is located axially downstream of the first opening 106 (i.e., relative to the direction of expanding propellant flow through the bore 104, or left to right in the Figure). The third opening 110 is located axially downstream of the second opening 108.

The positioning of baffles 117 just rearward of 120 and 122 maximizes expansion volume in the chamber formed by second portion 116 while reducing main bypass leakage inward through openings 120 and 122. The baffles 117 also provide paths for the thermal conduction of heat radially out from the suppressor 100. Furthermore, simulations have shown that the positioning of the baffles 117 as shown in FIG. 5 (i.e., all depending from outer wall 132) provides more of an impediment to the expanding propellant flow than an alternately "staggered" arrangement where every other baffle 117 depends from the wall separating first and second portions 114 and 116, respectively.

With further reference to FIG. 5, a cross sectional area of the first portion 114 of the serpentine flow path is represented by arrow 114*a*. The second opening 108 is in communication with a fourth opening 120 in the second portion 116, while the third opening 110 is in flow communication with a fifth opening 122 in the second portion 116. A sixth opening 124 is communication with the third portion 118. A discharge port 126 communicates with the bore 104 and may include a frusto-conical wall portion 128 to further expand the expanding propellant flow as it exits the discharge port 126.

Figure 7:
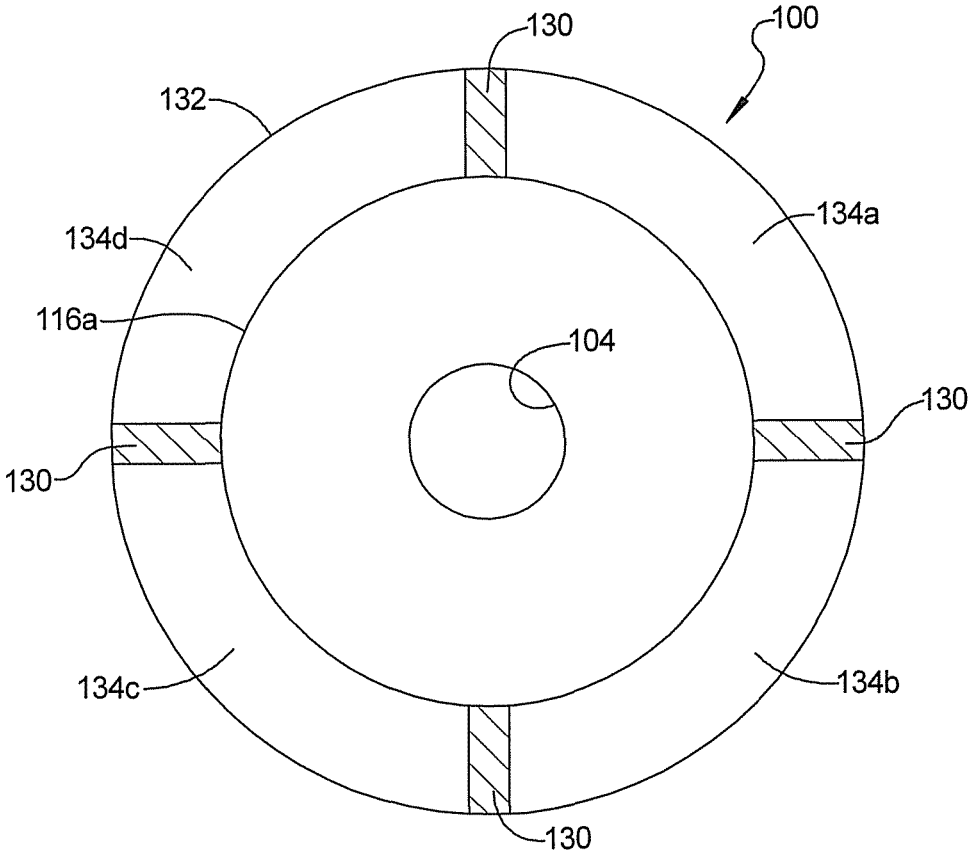
FIG. 7 is a cross sectional end view of the suppressor in accordance with section line 7-7 in FIG. 5 illustrating a plurality of radially extending internal ribs that help significantly to dissipate heat deposited within the suppressor.

Referring briefly to FIG. 7 another important feature of the suppressor 100 can be seen, which comprises a plurality of radially extending ribs 130. The ribs 130 are formed to extend radially outwardly from a wall portion 116*a* defining the second portion 116 of the serpentine flow path 112 the bore 104 toward the outer wall portion 132 of the suppressor 100. The ribs 130 form four distinct, axial flow regions 134*a*-134*d* within the second portion 116 of the suppressor 100. It will be appreciated, however, that a greater or lesser plurality of ribs 130 could be used to form a greater or lesser number of distinct, axial flow regions within the suppressor 100, and the precise number of ribs 130 selected for may depend in part on the specific weapon that the suppressor 100 is intended for use with and/or the caliber of the weapon.

The ribs 130 operate essentially as heat sinks to channel heat deposited within the suppressor 100 radially outwardly to the outer wall portion 132. The ribs 130 help significantly to maintain a homogeneous temperature throughout the interior area of the suppressor 100 and inhibit significant temperature gradients from developing, which could be detrimental to the longevity of the suppressor. The use of the radially extending ribs 130 is expected to significantly enhance the longevity of the suppressor 100.

Referring further to FIG. 6, the operation of the suppressor 100 is similar to the operation of the suppressor 10. The reverse flow path formed by first portion 114, in combination with the opening 106, causes a high pressure region near the downstream end of the opening 106, which creates a compact Mach disk at or adjacent to a downstream end of the opening 106. The Mach disk acts as a "virtual baffle" that diverts a portion of the expanding propellant gasses flowing through the bore 104 through the first opening 106 into the first portion 114. The ratio of the cylindrically shaped area of the opening 106 represented in part by line 106*a*, to the cross sectional area represented in part by arrow 114*a*, is also preferably close to or about 1:1, or slightly greater than 1:1. The ratio of the cylindrically shaped area of the second opening 108 to the minimum area of the fourth opening 120 (represented in part by line 108*b*), is also close to about 1:1. The axial width of each opening 106 and 108 (represented by axial lines 106*a* and 108*a*, respectively) is also preferably kept between about three to four bore diameters.

The ratio of the cylindrically shaped areas of the third opening 110 and the fifth opening 122 are likewise preferably at about 1:1, and possibly larger. The third chamber provides additional bleed off of boreline flow, and additional tortuosity, but there is insufficient pressure to form a third Mach disk in the present design. It will be noted that the openings 120 and 122 are also rearwardly (relative to the direction of expanding propellant flow) of their respective openings 108 and 110. As best understood, it is believed that the stagnation of the flow and increase in pressure near the right side (i.e. downstream end) of 108/108*a* allows an additional Mach disk to be formed in 108/108*a* just upstream of the high pressure. The shell exit area 108*b* strikes a balance between helping to maintain the pressure, but also allowing propellant to exit into 116 and further deplete the axial flow along the boreline. The Mach disk created at or adjacent to the second opening 108, in conjunction with the re-entrant expanding propellant gasses flowing through the conical-shaped third portion 118 and through the discharge port 126, further helps to eliminate or substantially reduce the occurrence of flash at the discharge port 126, and downstream of the discharge port 126, for the first shot and subsequent shots thereafter.

It will be appreciated that while the suppressors 10 and 100 described herein do not require an independent circumferential flow turning vane to be disposed at the openings 22, 106, 108, that such a turning vane could be incorporated if desired. However it is believed that incorporating such a turning vane will not enhance performance of the suppressors 10 and 100, and most likely will actually inhibit the generation of Mach disks at these openings.

Testing has revealed that the suppressor 100 provides even further enhanced noise reduction (about 2 dB) over the suppressor 10. The configuration of the suppressor 100 also helps to significantly reduce flash, and particularly flash from the first round of ammunition fired, by introducing some delay via tortuosity from the bore line 104*a* to the chamber formed by the second portion 116, and then back to the bore line. This produces a slightly greater dwell time and enhanced heat transfer to the suppressor 100, which in turn provides greater cooling to the exiting expanding propellant gasses. It also provides a reduction in luminosity of first round flash by a factor of about 15 as compared to the suppressor 10.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A suppressor for use with a weapon that fires a bullet, the suppressor adapted to be secured to a distal end of a barrel of the weapon, the suppressor including:

a body portion having a bore extending concentric with a bore axis of the barrel when the suppressor is attached to the distal end of the barrel;

an opening in the bore of the body portion extending at least substantially circumferentially around the bore;

a flow path in communication with the opening and defining a channel for redirecting expanding propellant gasses flowing in a forward direction in the bore out from the bore, through the opening, initially into a rearward direction in the flow path, and subsequently back into the bore, and wherein the flow path helps to raise a pressure at the opening to a level which is sufficient to generate a Mach disk within the bore at a location approximately coincident with the opening, when a bullet from a cartridge is fired into the barrel, the Mach disk acting as a virtual baffle to divert at least a portion of the expanding propellant gasses behind the bullet into the opening and into the rearward direction defined by the flow path; and a discharge port in communication with the bore, the discharge port being formed at a downstream end of the suppressor where the bullet and the expanding propellant gasses exit the barrel.

2. The suppressor of claim 1, wherein the opening defines a first area;

wherein the flow path has a first portion and a second portion, the first portion redirecting the expanding propellant gasses rearwardly and defining a second cross sectional area; and wherein the first area is one of approximately equal to or slightly greater than the second cross sectional area, to help in raising the pressure at the opening.

3. The suppressor of claim 2, wherein the first portion of the flow path extends parallel to the bore.

4. The suppressor of claim 3, wherein the second portion of the flow path extends concentrically with the first portion, and the second portion is disposed radially outwardly of the first portion, and wherein the first portion and the second portion form a serpentine flow path.

5. The suppressor of claim 1, wherein the flow path includes a plurality of baffles.

6. The suppressor of claim 5, wherein the flow path includes a first portion in communication with a second portion, the first portion redirecting the expanding propellant gasses in the rearward direction, and wherein the second portion includes the plurality of baffles, the baffles extending perpendicular to the bore axis.

7. The suppressor of claim 2, wherein the second portion includes a downstream area, the downstream area being in communication with the bore.

8. The suppressor of claim 7, wherein the downstream area includes a plurality of vanes projecting radially outwardly from the bore for enabling the expanding propellant gasses to both be initially diverted from the bore into the downstream portion, and also subsequently enabling a portion of the expanding propellant gasses residing within the downstream portion to be discharged from the downstream portion back into the bore of the suppressor; and wherein the vanes are swept to extend at an angle non-orthogonal to the bore axis.

9. The suppressor of claim 1, wherein the discharge nozzle includes a frusto-conical portion that provides an increasing flow area for the expanding propellant gasses to expand as the expanding propellant gasses leave the discharge port.

10. The suppressor of claim 2, wherein the second portion of the flow path extends parallel to the first portion, and the first portion extends parallel to the bore axis.

11. The suppressor of claim 1, further comprising a second opening in the bore axially downstream of the first opening, and in flow communication with the flow path, for creating a second Mach disk at or adjacent to the second opening, to further divert a portion of the expanding propellant gasses out from the bore.

12. The suppressor of claim 11, further comprising a third opening in the bore axially downstream of the second opening, and in flow communication with the flow path, to further help divert a portion of the expanding propellant flow out from the bore.

13. The suppressor of claim 1, further comprising a plurality of radially extending ribs extending from a portion of the flow path to an outer wall portion of the suppressor for separating a portion of an interior area of the suppressor into a plurality of distinct flow regions and conducting heat deposited within the suppressor radially outwardly to the outer wall portion, to improve the homogeneity of temperature within the suppressor.

14. A suppressor for use with a weapon that fires a bullet, the suppressor adapted to be secured to a distal end of a barrel of the weapon, the suppressor including:

a body portion having a bore extending concentric with a bore axis of the barrel when the suppressor is attached to the distal end of the barrel;

an opening formed in the bore of the body portion, the opening defining a first area extending circumferentially around the bore;

a serpentine flow path in communication with the opening, the serpentine flow path having a first portion, a second portion, and a downstream portion, the first portion redirecting expanding propellant gasses flowing in a forward direction in the bore in a rearward direction and defining a second area;

the first portion of the serpentine flow path and the opening cooperating to create an increase in pressure at the opening to a level which is sufficient to create a Mach disk at or adjacent to the opening, and wherein the Mach disk acts as a virtual baffle to divert the expanding propellant gasses behind a bullet travelling through the bore from the bore into the opening, and into the first portion of the serpentine flow path; and a discharge port in communication with the bore, the discharge port being formed at a downstream end of the suppressor where the bullet and the expanding propellant gasses exit the barrel.

15. The suppressor of claim 14, wherein the first and second flow portions of the serpentine flow path extend parallel to one another and coaxial with the bore of the suppressor.

16. The suppressor of claim 15, wherein the second portion of the serpentine flow path includes a plurality of baffles.

17. The suppressor of claim 14, wherein the downstream portion of the serpentine flow path includes a plurality of vanes in flow communication with the bore of the suppressor, and wherein the vanes are disposed downstream of the opening relative to a direction of flow of the expanding propellant gasses, and wherein the vanes are angled to extend non-orthogonal to the bore to assist in diverting a portion of the expanding propellant gasses out from the bore of the suppressor into the downstream portion to thus delay discharge of the expanding propellant gasses from the suppressor.

18. The suppressor of claim 14, wherein the discharge port includes a frusto-conical portion that provides an increasing flow area for the expanding propellant gasses to expand as the expanding propellant gasses leave the discharge port.

19. The suppressor of claim 14, wherein the first portion and a substantial length of the second portion are formed to reside substantially upstream of the opening, relative to a direction of flow of the expanding propellant gasses through the bore of the suppressor.

20. The suppressor of claim 14, wherein the bore includes a second opening in communication with the serpentine flow path for generating an additional Mach disk, the additional Mach disk acting as an additional virtual baffle for diverting an additional portion of the expanding propellant flow out from the bore into the serpentine flow path.

21. The suppressor of claim 14, further comprising a plurality of radially extending wall portions that separate a portion of the serpentine flow path into a plurality of distinct flow regions, and which help conduct heat generated within the suppressor radially outward to an outer wall portion of the suppressor.

22. A method for suppressing flash and attenuating noise from a weapon that fires a bullet, the flash and noise being generated by expanding propellant gasses exiting from a distal end of a barrel of the weapon as the bullet is fired from the weapon, the method comprising:

securing a suppressor body having a bore, an opening in the bore in flow communication with a serpentine flow path for diverting expanding propellant gasses flowing in a forward direction through the bore out from the bore, and redirecting the expanding propellant gasses in a rearward direction into the serpentine flow path; and using the serpentine flow path and the opening operating to create a volume of increased pressure at the opening sufficient to create a Mach disk within the bore at or adjacent to the opening, the Mach disk acting as a virtual baffle to divert a portion of the expanding propellant flow out from the bore through the opening and into the serpentine flow path.

* * * * *